US005924868A

United States Patent [19]

Rod

[11] Patent Number: 5,924,868

[45] Date of Patent: Jul. 20, 1999

[54] METHOD AND APPARATUS FOR TRAINING A SHOOTER OF A FIREARM

[76] Inventor: Samuel R. Rod, 11316 Bright Pond La., Reston, Va. 20194

[21] Appl. No.: 08/718,130

[22] Filed: Sep. 18, 1996

[51] Int. Cl.[6] ..... F41G 3/26

[52] U.S. Cl. ..... 434/19; 434/16; 434/20; 348/158; 89/41.05

[58] Field of Search ..... 434/11, 16, 19–23; 348/53, 121, 158; 89/41.05

[56] References Cited

U.S. PATENT DOCUMENTS

| | | | |
|---|---|---|---|
| 3,798,796 | 3/1974 | Stauff et al. | 434/20 |
| 4,516,157 | 5/1985 | Campbell | 348/158 |
| 4,534,735 | 8/1985 | Allard et al. | 434/20 |
| 4,884,137 | 11/1989 | Hansoin et al. | 348/158 |

OTHER PUBLICATIONS

User's Guide for TASCO NV–118 Night Vision Scope, which is representative of prior art IR Vision Systems.

Brochure entitled "The Mobile Assistant", a Voice–Activated Wearable Computer System, Xybernaut Corporation.

"Mobile Assistant MAS–2000 Belt–worn Computer", Zybernaut Corporation, 1996.

The "i Virtual glasses!" User's Guide, Virtual I.O. Inc., Aug., 1995.

*Primary Examiner*—John Mulcahy

*Attorney, Agent, or Firm*—Burns, Doane, Swecker & Mathis LLP

[57] ABSTRACT

A video camera mounted on eyewear worn by a shooter produces displayed images used by the shooter in aiming the firearm. The displayed image, rather than a direct view of a target is used in aiming the firearm. These images may be subsequently reviewed by the shooter or viewed by an instructor. A viewer of the displayed image is able to see the aiming as the shooter actually sees it, and correlate it with success or failure in hitting a target.

13 Claims, 3 Drawing Sheets

METHOD AND APPARATUS FOR TRAINING A SHOOTER OF A FIREARM

FIELD OF THE INVENTION

The present invention relates to methods and apparatus for training or instructing in the use of a weapon, firearm or other optically aimed device.

BACKGROUND OF THE INVENTION

Instruction in the proper use of firearms is an important part of the training of military and law enforcement personnel. It is also of interest to sportsmen, particularly instruction which promotes safer use of firearms in recreational settings.

In conventional firearm training, the student is instructed as to the proper stance, aiming and firing of the firearm. This may involve firing in various positions or while moving with respect to the target. Accuracy can be determined by examining the location of bullet holes in the target. Some students, however, have difficulty developing the skills necessary to properly position the firearm through aiming, the instant of firing and the follow-through. These difficulties greatly increase instructional costs and may prevent otherwise well-qualified candidates from entering some military or law enforcement services.

SUMMARY OF INVENTION AND OBJECTS

The inventor has discovered that effective training of a shooter can be achieved by reproducing for an instructor and student essentially exactly what the shooter sees from the moment the shooter begins to align the firearm sights, through the instant of firing and the follow-through. With the aid of the disclosed techniques, the shooter can be trained to reproduce certain geometrics in aiming and firing the firearm. Both student and instructor have the benefit of the same image or line of sight and may share the same live view. Particular images obtained during aiming and firing may be replayed or correlated with success or failure in hitting the target. In this way a shooter's weakness and bad habits may be analyzed and corrected.

The inventor has also discovered that it does not suffice to simply mount a camera on the head of the shooter. Images obtained from such a system do not take into account the shooter's eye movements and positions. Accordingly, the techniques discussed herein employ both a camera and display eyewear for the shooter.

A preferred embodiment of the present invention is a process for training a shooter in the aiming of a firearm. In practicing the process, an input optical axis of a video camera is positioned approximately parallel to a normal direct line of sight of the shooter. The optical axis may be displaced slightly from the shooter's line of sight or may be colinear with it. Advantageously, the camera may be positioned by mounting the camera on a set of video display eyewear. The video camera provides a video signal which is displayed to at least one of the shooter's eyes in the eyewear as a substitute for a view in the direct line of sight of the shooter. The shooter uses the displayed image from the eyewear to sight the firearm. The firearm is fired and the result of the firing is correlated with the displayed video signal. In preferred embodiments, the video signal may be recorded and played back for the shooter and/or the instructor. In another embodiment, the video signal from the head-mounted camera is superimposed with either a view of the results of the firing of the firearm or the view from a tripod-mounted camera positioned so as to record the image of the shooter's hand, arm or body during firing of the firearm.

The present invention also relates to an apparatus for training a shooter of a firearm. The apparatus includes a video camera having an input optical axis aligned to approximate a typical line of sight for the shooter, which video camera produces a video signal representing the shooter's normal view on that line of sight. The apparatus also includes a means for displaying the video signal to at least one of the shooter's eyes, the displayed video signal substituting for a direct view of at least one of the shooter's eyes. The apparatus is used to sight a firearm using the sighting means associated with the firearm. Such sighting typically involves the alignment of an optical positioning indicator on the firearm with a view of the target. Finally, the apparatus includes means for correlating the displayed video signal with a result of the firearm firing.

In preferred embodiments, the camera is pivotably mounted on the eyewear so that the input optical axis of the video camera is selectively positionable with respect to the head of the shooter. This selectively positionable feature permits the optical input axis of the camera to be aligned with a line of sight of either the left or the right eye of the shooter. The vertical elevation of the optical input axis may be varied, and the angle with respect to the plane of the face of the shooter may be varied as well. In this way, the optical axis of the camera may be selectively positioned with respect to the eyewear to permit the shooter to shoot comfortably with either or both eyes open and in various postures.

In another embodiment of the present invention the eyewear is binocular video eyewear with separate flat panel video displays for the left eye and the right eye. In yet a further embodiment, the video camera is selectively focusable to replicate the focus and focus depth normally used by the shooter in aiming the firearm.

It is an object of the present invention to provide methods and apparatus for effectively training individuals in optical aiming, particularly of firearms.

It is a further object of the present invention to aid a shooter and instructor in making efficient use of training time both on the firing range and in the classroom.

It is a further object of the present invention to permit a firearm instructor and shooter to share the same line of sight and view from the moment the shooter begins to align the firearm's sights through the instant of firing and the follow-through.

It is a further object of the present invention to provide training apparatus which substitutes a reproducible, displayed image for a direct view of the target used in aiming.

It is a further object of the present invention to provide an eyewear-mounted video camera with an optical axis selectively positionable with respect to the eyewear, adapted to permit the shooter to shoot comfortably with either or both eyes open and in various postures.

It is a further object of the present invention to permit the view of the shooter to be displayed or redisplayed and correlated with the result of the firing of the firearm.

It is a further object of the present invention to provide an aid to shooters, so that the shooter can learn to reproduce certain geometries associated with the accurate aiming and firing of a firearm.

These and other objects and features of the invention will be apparent from the following detailed description of the preferred embodiments.

DETAILED DESCRIPTION OF PREFERRED EMBODIMENTS

Various preferred embodiments of the present invention will now be described with reference to the drawings.

Figure 1:
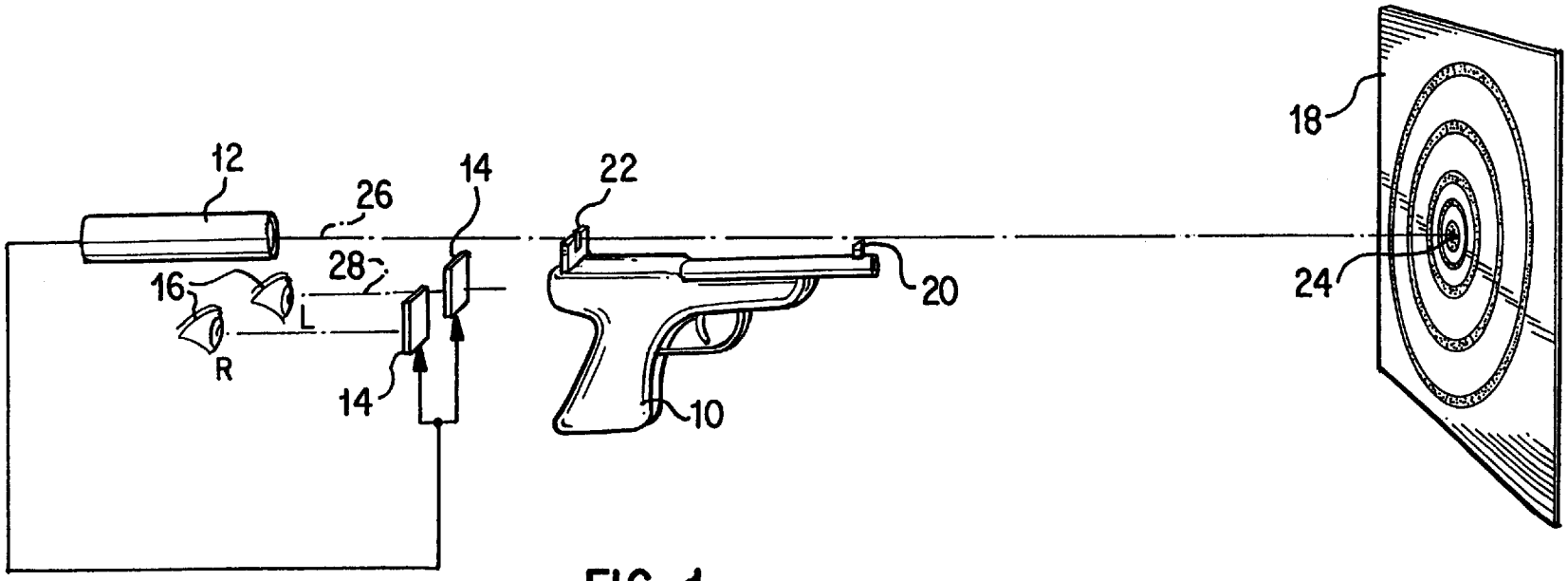
FIG. 1 is a perspective view of portions of an embodiment of the present invention illustrating certain geometrical relationships in the aiming of a firearm.

FIG. 1 is a perspective view of portions of an embodiment of the present invention illustrating certain geometrical relationships in the aiming of a firearm 10. The system includes a video camera 12 and one or more optical display panels 14 positioned in gear or goggles (not shown) worn by the shooter. The shooter's eyes are depicted at 16. A target 18 is located at a distance from the firearm 10. In FIG. 1, the target 18 is shown as the familiar bullseye firing range target. However, it should be understood that the word "target" is used herein to identify generally any object or image desired to be hit or aimed at.

Figure 1A:
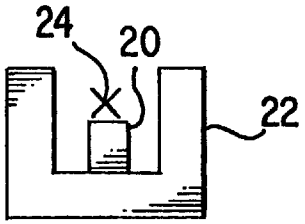
FIG. 1*a* is a pictorial depiction of a view through the sight of the firearm shown in FIG. 1.

The firearm shown in the embodiment of FIG. 1 is equipped with a front sight 20 and a rear sight 22. In normal operation the shooter optically aligns the front sight, the rear sight and the point 24 of the target. FIG. 1*a* is a pictorial depiction of the view through the sight of the firearm shown in FIG. 1 when aiming is achieved. In this case a three-point alignment has been made between the front sight 20, the rear sight 22 and the point 24. While this embodiment is described with reference to this particular firearm sighting system, it will be readily understood that invention can be used with other optical sighting systems.

With continued reference to FIG. 1, the camera 12 is shown as having an optical input axis 26 which is positioned to approximate a typical or natural line of sight 28 of the shooter. The camera produces a video signal approximately representing the shooter's view at that line of sight. The video signal is applied to the one or more flat panel displays 14.

As shown in FIG. 1, the display 14 for the video signal substitutes for a direct field of view of the shooter's left eye. In this way the video camera simulates an aiming of the firearm done with the left eye. It will be understood that effective simulation requires positioning of the video camera to provide a displayed image approximating the view which the shooter would have in aiming, e.g. on the natural line of sight 28 of the shooter.

The view of the shooter obtained with the video camera can be displayed or redisplayed and correlated with the result of the firing of the firearm. These displays can provide aids to shooters and shooting instructors in learning to reproduce certain geometries associated with the accurate aiming of the firearm. The system allows the instructor to see virtually exactly what the shooter sees from the moment the shooter begins to align the firearm sight, through the instant of firing and the follow through.

Figure 2:
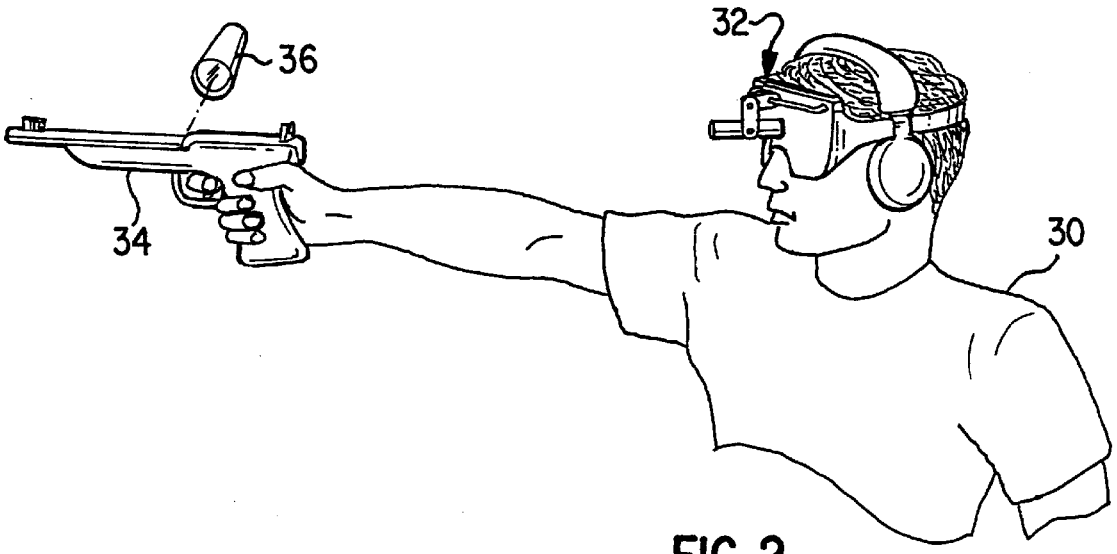
FIG. 2 is a pictorial view of a shooter equipped with an embodiment of the training apparatus of the present invention.

FIG. 2 is a pictorial view of a shooter equipped with an embodiment 22 of the apparatus of the present invention. In the Figure the shooter 30 is shown wearing eyewear 32 and aiming the firearm 34 in a standing position, though the system is adaptable to use in other firing postures. The firearm 34 may be equipped with any conventional optical sight including the optical sight shown and described in connection with FIG. 1 or a conventional laser red dot optical sight.

FIG. 2 also shows an optional side view camera 36 for obtaining side images of the aiming and firing of the firearm which may be employed in the overall training system as described in greater detail below.

Figure 2A:
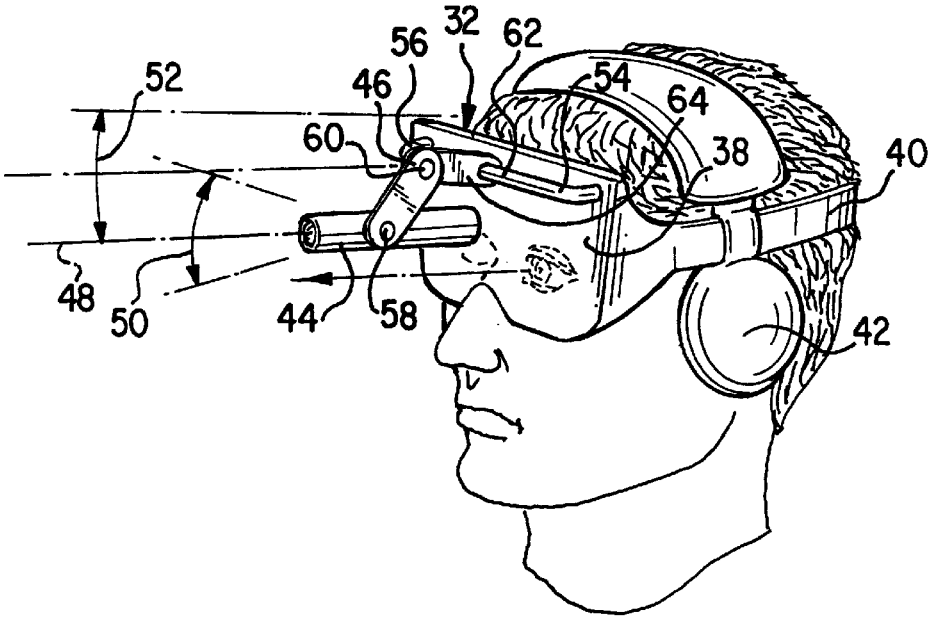
FIG. 2*a* is a detail of the eyewear embodiment shown in FIG. 2 illustrating the selectively positionable components of a camera mount.

FIG. 2*a* is a detail of the eyewear and camera embodiment of the present invention shown in FIG. 2. The eyewear 32 may include a high resolution binocular video display 38 held in position on the head of the shooter by a band 40. A suitable display system is sold under the trademark VIRTUAL I-GLASSES manufactured by Virtual I.O. Inc. Normally, shooters aim using one eye with the other eye closed. However, images may be displayed to both eyes, and if desired, the images may be stereoscopic.

In a preferred embodiment, the eyewear may be equipped with optional ear protectors. Earphones 42 may provide both protection and audio communication from the instructor.

A video camera 44 is mounted on the eyewear 32. Advantageously, the camera may be of the miniature high resolution variety, for example, a 7 mm CCD camera with 120,000 to 180,000 pixel resolution producing 60 fields or 30 frames per second. Associated control and power circuitry for the camera (not shown) may be worn on the body of the shooter. Also, advantageously the camera may be provided with means for adjusting the focus and focusing depth of the camera, so that the image displayed to the shooter replicates the natural focus and focusing depth of the shooter when using the unaided eye to aim the firearm. A video output signal from the camera may be applied to LCD display panel or panels in the eyewear 32 and also be provided to other associated circuitry and displays described in greater detail in connection with FIG. 3.

With continued reference to FIG. 2(*a*), the camera 44 is shown attached to the eyewear 32 by a camera mount 46. The camera mount 46 facilitates the selective positioning of the optical axis 48 of camera 44 to conform with the shooter's choice of eye and posture in aiming the firearm. In the position shown in FIG. 2*a*, the camera is shown in a position which would replicate a typical direct line of sight for both left and right eyes for a standing shooter. However, the camera and its optical axis 48 can be repositioned in several different ways. First, the optical axis can be repositioned at different angles with respect to the face of the shooter as indicated by the double headed arrow 50. The elevation of the optical axis 48 can be repositioned through a range of elevations indicated by the double headed arrow 52. Finally, the camera mount 46 can be relocated to a left position 54 or a right position 56 to more accurately approximate the natural line of sight of the shooter using his left eye or right eye, respectively. In the embodiment shown in FIG. 2*a* the selected positioning of the optical axis 48 is accomplished by use of pivoting pins 58 and 60 and a slide rod 62 releasably engaged to the camera mount at 64. In use the camera mount can be slid to any position between the ends of the rod 62 to approximate the natural line of sight of the left eye, right eye or a combination of both. Alternatively, releasable fasteners and corresponding mounting holes on the eyewear (not shown) may be employed to change the location of the camera on the eyewear.

Figure 3:
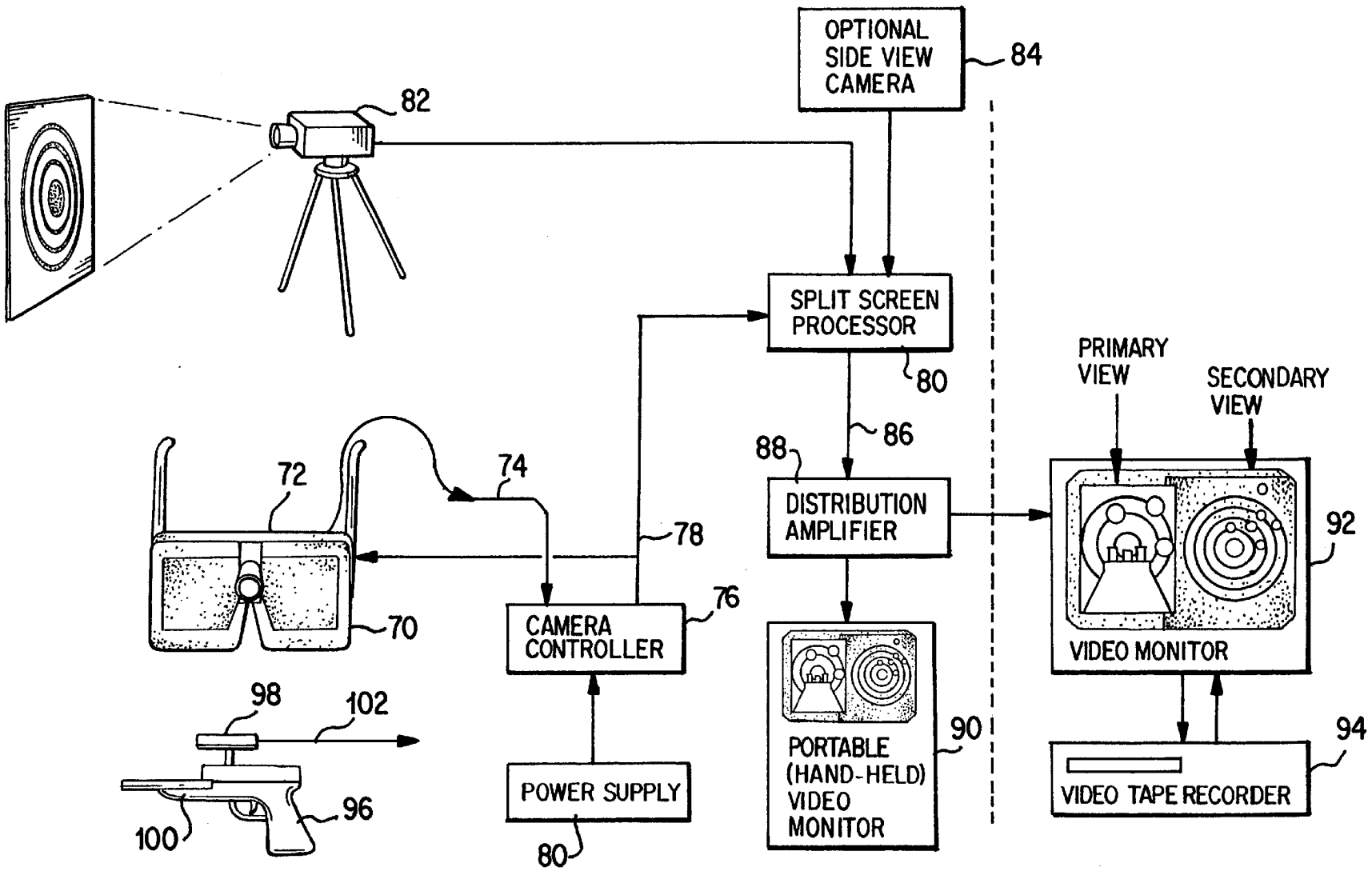
FIG. 3 is a schematic block diagram of system embodiments of the present invention, illustrating certain aspects of image processing and display.

FIG. 3 is a schematic block diagram of a system embodiment of the present invention illustrating certain useful image processing and display techniques. The principle components of the system illustrated in FIG. 3 are the camera and display eyewear 70 and display monitors for use by the shooter and/or the instructor. In the system of FIG. 3 a head mounted camera 72 with an optical axis approximately parallel to a direct line of sight of the shooter provides a video signal 74 to a camera controller 76. The camera controller 76, in turn, provides a video signal 78 back to the eyewear 70 where it is displayed to one or more eyes of the shooter during aiming and firing of the firearm. The camera controller 76 is also equipped with a power supply 80. Both the camera controller 76 and power supply 80 may be worn by the shooter, for example, as an integrated belt mounted unit with video signal cabling running to the eyewear 70.

The video output signal 78 of the camera controller 76 may also be applied to a conventional split screen processor 80. Optionally, the split screen processor may receive signals from a target camera 82 focused on the target to view the results of the firing, or from an optional side view camera 84 such as that also shown in FIG. 2. An output signal 86 from the split screen processor may be applied to a distribution amplifier 88 which in turn provides signals for additional displays of the view through the camera 72 as well as (optionally) for views from the target camera 82 or the side view camera 84. Output signals of the distribution amplifier 88 may, for example, be applied to a portable hand-held video monitor 90, such as a WATCHMAN television display used at the target range. Alternatively or in addition, an output signal from the distribution amplifier 88 may be applied to a larger video monitor 92 used in a control booth or classroom by students and instructors.

The system may also include a videotape recorder 94 for replaying video images of the various views obtained by the cameras in the system. The recorded video signal may, for example, be played back and displayed on the portable hand-held video monitor 90, on the larger video monitor 92 in a control booth or classroom or on the display panels of the eyewear 70.

An alternative camera system 96 is also illustrated in FIG. 3. In this system a rail mounted camera 98 is attached to firearm 100 and provides a video signal 102 to the camera controller 76.

In FIG. 3 there is also illustrated examples of views which may be displayed to correlate the images used by the shooter in aiming the firearm with the results of the firing of the firearm. For example, the video monitors 90 and 92 are shown with a split screen display comprising a primary view and a secondary view. The primary view is a display of the video signal corresponding to the display used by the shooter in actually aiming and firing the firearm. The secondary view is a close-up view obtained from the target camera 82 which shows the results of the firing. With the aid of the video tape recorder 94, instantaneous or delayed stop action viewing may be obtained. With the use of the target camera 82 and the split screen display, the instructor can instantaneously see how well the shooter performs and make on-the-spot suggestions for improvement. The shooter's weaknesses and bad habits can be minimized or eliminated, and strengths positively reinforced by use of the described systems.

The invention herein has been described with reference to certain preferred embodiments. However, it should be understood that the scope of the invention is set out in the following claims and equivalents thereof recognized under law.

I claim:

1. A process for training a shooter in the aiming of a firearm equipped with a sight comprising the steps of:

fixing an input optical axis of a video camera with respect to the head of the shooter to approximate the natural direct line of sight of the shooter which would normally be used in sighting the firearm through the sight;

providing a video signal from the video camera;

displaying the video signal to at least one of the shooter's eyes as a substitute for the view in the direct line of sight of the shooter;

sighting the firearm using the display of the firearm sight;

firing the firearm; and correlating the displayed video signal with the result of the firing of the firearm.

2. The process of claim 1, wherein the firearm is a handgun with an open sight.

3. The process of claim 1, wherein the optical axis of the video camera is aligned with the sight and a target.

4. The process of claim 1, wherein the optical axis of the video camera is fixed in a position by adjusting the axis into approximate alignment with an axis connecting the shooter's eye, the sight and a target.

5. The method of claim 1, further comprising the step of selectively adjusting the focus and focus depth of the video camera to more accurately replicate the shooter's normal vision in aiming the firearm.

6. The method of claim 1, further comprising the step of focusing a second video camera on the shooter and superimposing a view of the shooter onto a redisplayed view from the video camera approximating the natural, direct line of sight of the shooter.

7. The method of claim 1, wherein the input optical axis of the video camera is adjusted on eyewear worn on the head of the shooter to better approximate the natural, direct line of sight of the shooter prior to firing and fixed in that position.

8. The process of claim 1, wherein an instructor observes the displayed video signal and the result of the firing of the firearm.

9. The process of claim 1, wherein the video signal is recorded and played back for subsequent viewing by the shooter or an instructor.

10. The method of claim 9, further comprising the step of focusing a target video camera on a target and superimposing a close-up view of the target obtained from the target video camera onto a redisplayed view from the eyewear mounted video camera approximating the natural, direct line of sight of the shooter.

11. Apparatus for training a shooter of a handgun equipped with an open sight comprising:

head gear adapted to be worn by the shooter including:

a video camera selectively positionable with respect to the head of the shooter so that an input optical axis for the camera is aligned to approximate a natural line of sight for the shooter through the sight of the handgun, and for producing a video signal representing the shooter's view at that line of sight; and means for displaying the video signal to at least one of the shooter's eyes as a substitute for a direct field of view of at least one of the shooter's eyes; and means for remotely displaying the video signal to evaluate the aiming and firing of the handgun;

wherein the means for remotely displaying the video signal includes a video recorder and video monitor for recording and redisplaying the video signal, and a target video camera focused on a target and means for superimposing a view of the target on a redisplayed view of the firing of the handgun.

12. The apparatus of claim 11, further comprising a video camera trained on the shooter.

13. Apparatus for training a shooter of a firearm comprising video display eyewear, a video camera mounted on the eyewear worn by the shooter having an input optical axis selectively positionable with respect to the eyewear so that it extends from a point in front of the shooter's eye to approximate the shooter's natural view for aiming the firearm through the sight, said video camera producing a video signal applied to the video display eyewear for use by a shooter in aiming of the firearm, means for replicating the video signal for evaluation, a target video camera focused on a target and means for superimposing a close-up view of the target obtained from the target video camera onto a redisplayed view from the eyewear mounted video camera.

* * * * *